United States Patent [19]

Taga

[11] Patent Number: 4,920,863

[45] Date of Patent: May 1, 1990

[54] PLUNGER PUMP

[75] Inventor: Jun Taga, Kawasaki, Japan

[73] Assignee: Mitsui & Co., Ltd., Tokyo, Japan

[21] Appl. No.: 167,476

[22] PCT Filed: Sep. 11, 1987

[86] PCT No.: PCT/JP87/00674

§ 371 Date: Jan. 27, 1988

§ 102(e) Date: Jan. 27, 1988

[87] PCT Pub. No.: WO88/02443

PCT Pub. Date: Apr. 7, 1988

[30] Foreign Application Priority Data

Sep. 24, 1986 [JP] Japan ..... 61-225716
Aug. 26, 1987 [JP] Japan ..... 62-211628

[51] Int. Cl.[5] ..... F04B 21/00
[52] U.S. Cl. ..... 92/86; 417/437
[58] Field of Search ..... 417/437; 92/86, 86–85

[56] References Cited

U.S. PATENT DOCUMENTS

| | | | |
|---|---|---|---|
| 547,012 | 10/1895 | Hardy | 92/86.5 |
| 1,483,143 | 2/1924 | Whitlock | 92/86.5 |
| 2,330,781 | 9/1943 | Languyhr | 92/86.5 |
| 2,913,989 | 11/1959 | Boardman et al. . | |
| 3,128,713 | 4/1964 | Nechine . | |
| 3,186,513 | 5/1965 | Dunn et al. . | |
| 3,229,900 | 1/1966 | McCory | 92/86.5 |
| 3,257,957 | 6/1966 | Tracy . | |
| 3,401,640 | 9/1968 | Fowler et al. . | |
| 3,495,544 | 2/1970 | Enssle | 417/568 |
| 3,532,244 | 10/1971 | Yates, Jr. . | |
| 3,572,976 | 3/1971 | Sato . | |
| 3,742,822 | 7/1973 | Talbert | 92/86 |
| 3,943,717 | 3/1976 | Schexnayder | 92/86 |
| 4,264,452 | 4/1981 | Chen . | |
| 4,776,260 | 10/1988 | Vincze | 92/86 |

FOREIGN PATENT DOCUMENTS

| | | | |
|---|---|---|---|
| 714290 | 11/1941 | Fed. Rep. of Germany . | |
| 1123075 | 9/1955 | Fed. Rep. of Germany | 92/86 |
| 1528547 | 11/1969 | Fed. Rep. of Germany | 417/437 |
| 3202538 | 8/1985 | Fed. Rep. of Germany | 92/86 |
| 2385912 | 12/1978 | France | 417/437 |
| 4321328 | 9/1965 | Japan . | |
| 58-8295 | 1/1983 | Japan . | |
| 641153 | 1/1979 | U.S.S.R. | 92/86.5 |
| 1021823 | 6/1983 | U.S.S.R. . | |
| 685455 | 1/1953 | United Kingdom . | |

*Primary Examiner*—Leonard E. Smith
*Assistant Examiner*—David W. Scheuermann
*Attorney, Agent, or Firm*—Kramer, Brufsky & Cifelli

[57] ABSTRACT

A plunger pump comprises a cylinder (1); a plunger (2) reciprocating within said cylinder; a sucking chamber (1*a*) formed upon a top of said plunger; a sucking pipe (4) and a discharge pipe (5) communicated with said sucking chamber; and slidable means (1*b*) formed upon an inner wall of said cylinder in the proximity of an open end thereof. The sucking chamber and the slidable means are intercepted from each other by an intercepting fluid stream formed therebetween, thereby any contaminants occurring from the slidable means are prevented from being penetrated into the sucking chamber, and discharged outside the plunger pump together with the intercepting fluid stream.

20 Claims, 7 Drawing Sheets

FIG. 1A
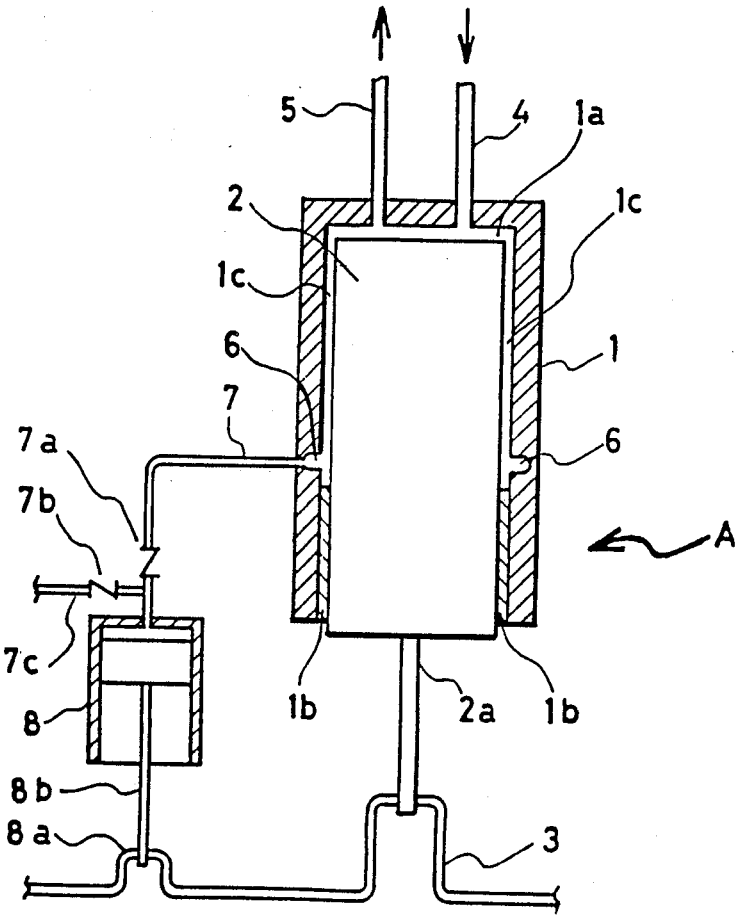
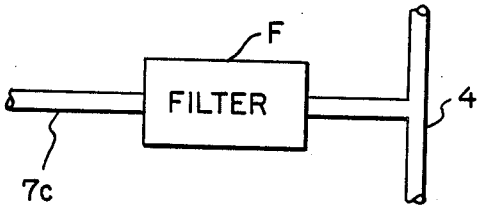
FIG. 1C

PLUNGER PUMP

TECHNICAL FIELD

This invention relates to a plunger pump for feeding ultrapure water, strong liquid and strong alkali liquid, in which any contaminants occuring from the slidable means disposed between a cylinder and a plunger are prevented from being mixed with a liquid flowing in the interior of the cylinder.

BACKGROUND ART

A conventional plunger/pump will now be discussed with a reference to FIG. 8.

In FIG. 8, a reciprocating plunger 2 in a cylinder 1 sucks a liquid through a sucking inlet pipe 4 and discharges it from a discharge pipe 5. Numeral 2*a* is a connecting rod and numeral 3 is a crank shaft for converting its rotation movement to a reciprocal movement of the plunger 2. Numeral 1*a* is a sucking chamber, in which a certain amount of sucked liquid remains until it is discharged from the discharge pipe 5. Numeral 1*b* is slidable means disposed upon an inner wall of the cylinder 1 and upon an outer wall of the plunger 2. At the moment the plunger 2 descends, the liquid is supplied into the sucking chamber 1*a* through the sucking pipe 4, which at the moment the plunger 2 ascends, it is discharged from the sucking chamber 1*a* to the discharge pipe 5.

A decisive disadvantage of such a conventional plunger pump is that since the slidable means 1*b* on the inner wall of the cylinder 1 and on the outer wall of the plunger 2 is directly communicated with the sucking chamber 1*a*, the contaminants occurring from the sliding result of the outer wall of the plunger 2 and the inner wall of the cylinder 1 are mixed with the liquid to be highly pure.

In particular, the liquid which is used in the purifying process when manufacturing medicines, chemical products, semiconductors or the like must maintain a high purity, but the liquid flowing in the interior of the conventional plunger pump is contaminated by such contaminants i.e. worn matters.

For instance, in the purifying process of semiconductor products, it is known that their yield is greatly dependent upon maintaining a high purity level of the purifying liquid as an ultrapure water. For this purpose, it is one way of solution to filter the liquid which has been discharged from the cylinder 1. However, one problem is that after the liquid has passed through a filter device, its pressure is decreased, thereby its feeding efficiency is reduced. A further problem is that since the liquid is flowing in a high pressure, the filter medium in the filter device will be rapidly wasted.

DISCLOSURE OF THE INVENTION

This invention provides a plunger pump, in which any contaminants occurring from the slidable means disposed between a cylinder and a plunger are prevented from being mixed with a liquid flowing in the interior of the cylinder.

More specifically, the plunger pump comprises a cylinder; a plunger reciprocating within the cylinder; a sucking chamber formed upon a top of the plunger; a sucking pipe and a discharge pipe communicated with the sucking chamber; and slidable means formed upon an inner wall of the cylinder in the proximity of an open end thereof. The sucking chamber and the slidable means are intercepted from each other by an intercepting fluid stream formed therebetween, thereby any contaminants occurring from the slidable means are prevented from being penetrated into the sucking chamber, and discharged outside the plunger pump together with the intercepting fluid stream.

BRIEF DESCRIPTION OF DRAWINGS

FIG. 1A is a section view of a plunger pump according to a first embodiment of this invention;

FIG. 1C is view of a filter provided in the discharge pipe;

THE BEST MODE FOR CARRYING OUT THE INVENTION

A first embodiment of this invention will now be described with reference to FIGS. 1A and 2.

Figure 8:
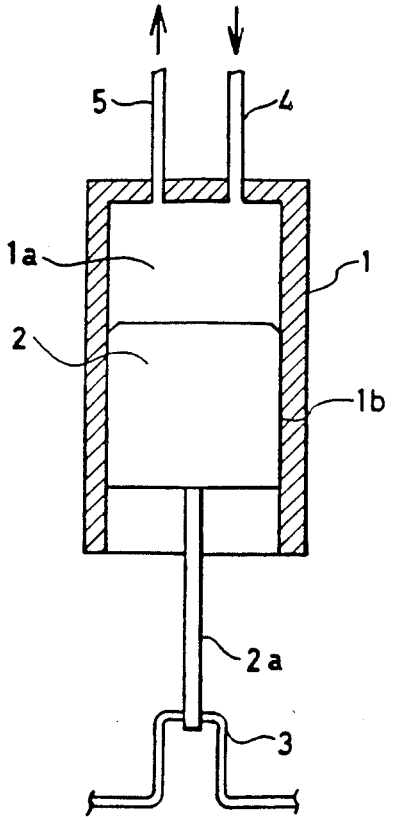
FIG. 8 (PRIOR ART)
FIG. 8 is a section view of a conventional plunger pump.

Since the same construction as the conventional example in FIG. 8 has the same numerals, its description will be omitted.

In FIG. 1A, there is shown a main plunger pump A, in which a cylinder 1 is, in the proximity of its open end, provided with a slidable means 1*b* which is fixed with an inner wall of the cylinder 1. Numeral 1*c* is a non-sliding slight annular gap formed immediately atop the slidable means 1*b*. More specifically, the slight gap 1*c* is formed between the inner wall of the cylinder 1 and the outer wall of the plunger 2, and its thickness is preferably from 0.1 mm to 1.0 mm.

Numeral 6 is an annular manifold groove which is formed at a lower end of the slight gap 1*c*. Numeral 7 is a subpipe as a discharge pipe directly communicated with the manifold groove 6. The subpipe 7 is connected to a small-sized subpump 8. Numerals 7*a* and 7*b* are non-return valves and numeral 7*c* is a discharge pipe diverged from the subpipe 7.

Numeral 8*b* is a connecting rod which is connected to a crank shaft 8*a*. The crank shaft 8*a* is integrally associated with the crank shaft 3 of the main pump A.

A function of this embodiment will now be described.

Figure 1B:
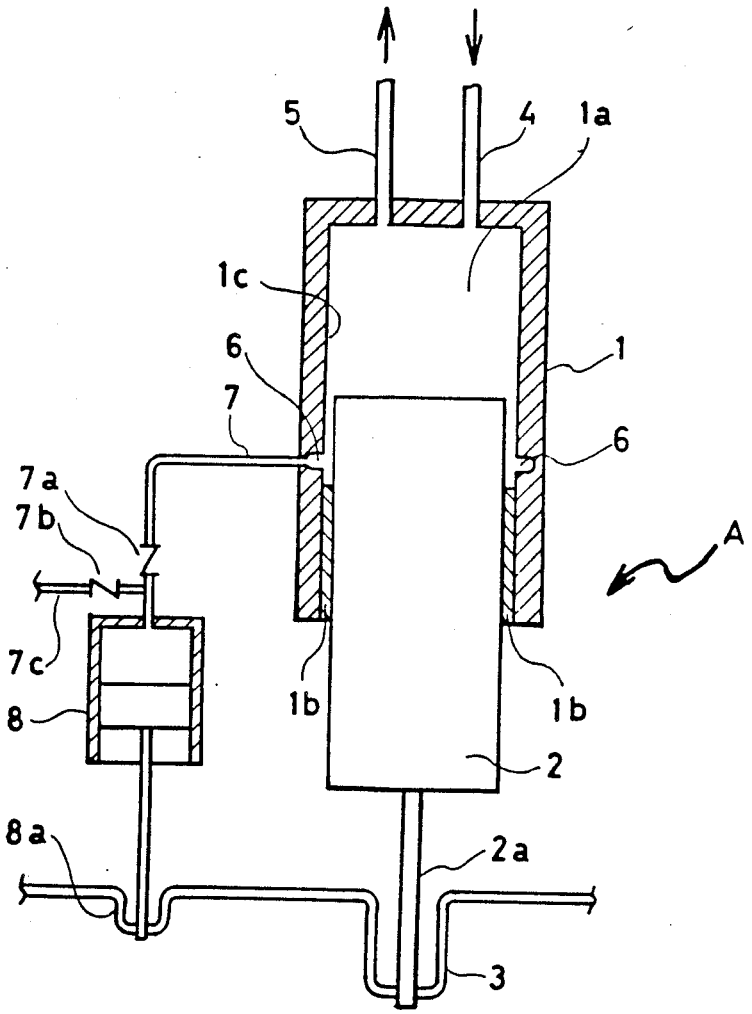
FIG. 1B is a section view of a plunger in FIG. 1A, in which a plunger is depressed.

When the plunger 2 is depressed by the crank shaft 3, the liquid is sucked through the sucking pipe 4 and supplied into the sucking chamber 1*a* as shown in FIG. 1B.

In synchronizing with the main pump A, the subpump 8 is also depressed, so that the sucked liquid is supplied to the discharge pipe 7 and the interior of the subpump 8 by way of the slight gap 1*c* and the manifold groove 6 respectively.

Subsequently, at the moment the plunger 2 ascends, the liquid in the sucking chamber 1*a* is discharged from the discharge pipe 5, and the liquid sucked in the subpump 8 is discharged from the diverged discharge pipe 7*c*. The aforesaid process is repeated continuously.

On the other hand, the contaminants i.e. worn matters which have occurred from the slidable means 1*b* are mixed with the liquid existing in the lower position of the small gap 1*c*, but such contaminated liquid is completely discharged from the subpipe 7 by operation of the subpump 8. Accordingly, the liquid existing in the sucking chamber 1*a* of the main pump A is never contaminated by such contaminants, and while keeping its high purity, it is discharged from the discharge pipe 5.

The liquid discharged from the diverged discharge pipe 7*c* is returned to the sucking pipe 4 by way of a filter as illustrated in FIG. 1C.

Figure 2:
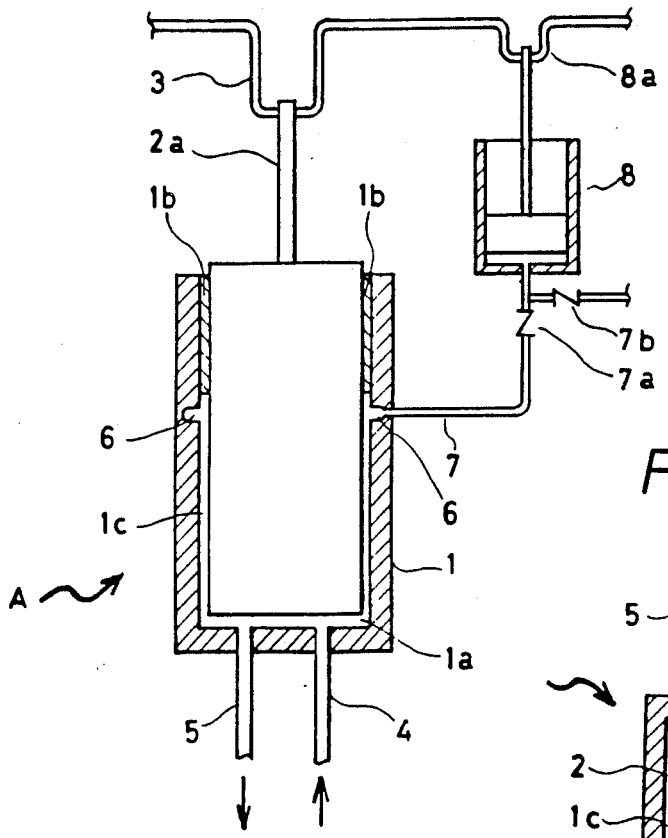
FIG. 2 is a section view of the plunger pump in FIG. 1, where it is inverted up to down.

FIG. 2 shows a condition, in which the plunger pump in FIG. 1A is inverted up to down. The plunger pump in FIG. 2 is applied for feeding a slurry or a liquid containing hard powders.

The reason why the plunger pump is inverted up to down is to prevent the fine particles or the like from being penetrated into the gap 1*c* by their own weight.

The operation of the main pump A and of the subpump 8 is the same as that in FIG. 1A, but the operation of the non-return valves 7*a*, 7*b* are different. Namely, the subpump 8 performs the function to supply the liquid (normally water) from the outside, but not to discharge it.

A second embodiment of this invention will now be described with reference to FIG. 3.

In this embodiment, the annular manifold groove 6 is communicated with two subpumps 8, 81 by way of the subpipe 7 and a second subpipe 71.

Numeral 81 is a second subpump connected to a second crank shaft 81*a* which is integrally associated with the crank shaft 3 of the main pump A.

Figure 3:
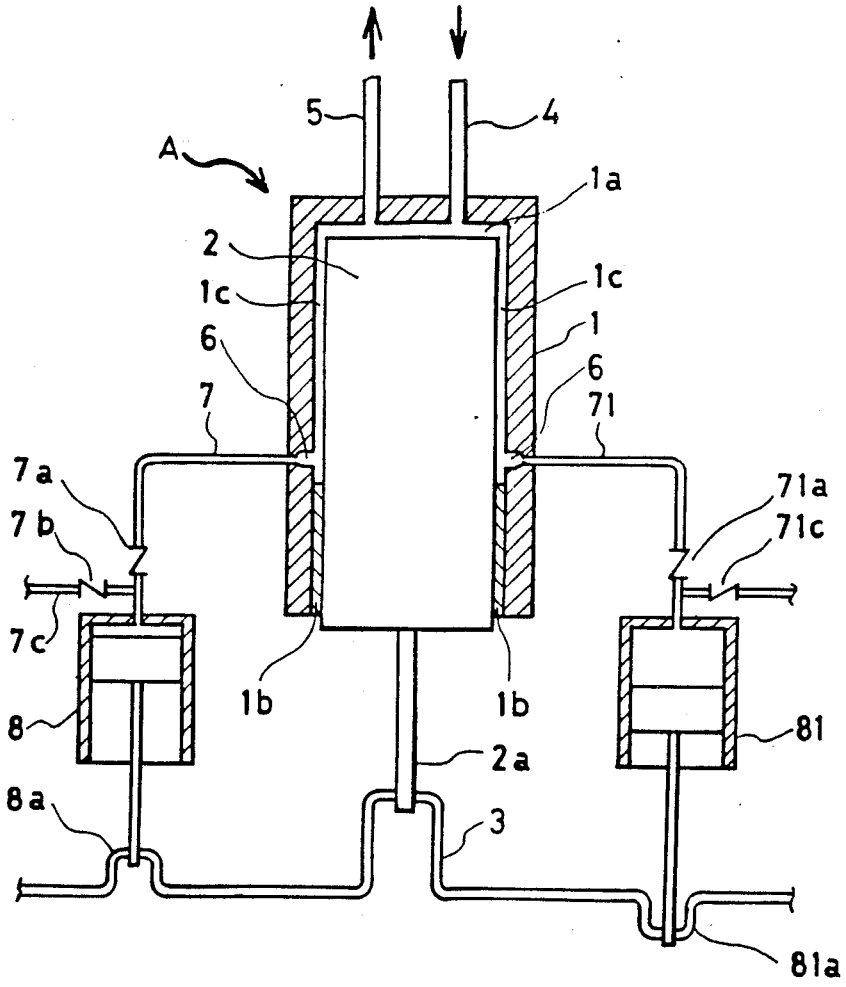
FIG. 3 is a section view of a plunger pump according to a second embodiment of this invention.

As shown in FIG. 3, the construction in FIG. 3 has a symmetrical configuration. Therefore, when the main pump A, the subpumps 8 and 81 are operated, the liquid is constantly supplied in the manifold groove 6, and continuously discharged from the subpipes 7, 71. Accordingly, since the liquid within the sucking chamber 1*a* of the main pump A is completely separated from the liquid contaminated by the contaminants occurring from the slidable means 1*b*, the former is surely prevented from being contaminated by the contaminants.

Further, when operating the non-return valves 7*a*, 7*b*, 71*a* and 71*c* in a reverse direction or when using strong acid or the like for the recycling purposes, a small quantity of water can be constantly supplied from the subpumps 8, 81.

Still further, the subpumps 8, 81 may be operated independently without interconnecting with the main pump A.

A third embodiment of this invention will now be described with reference to FIG. 4.

In this embodiment, the intercepting stream flowing in the manifold groove 6 and the subpipe 7 is formed without employing any pump for the discharge purpose.

Figure 4:
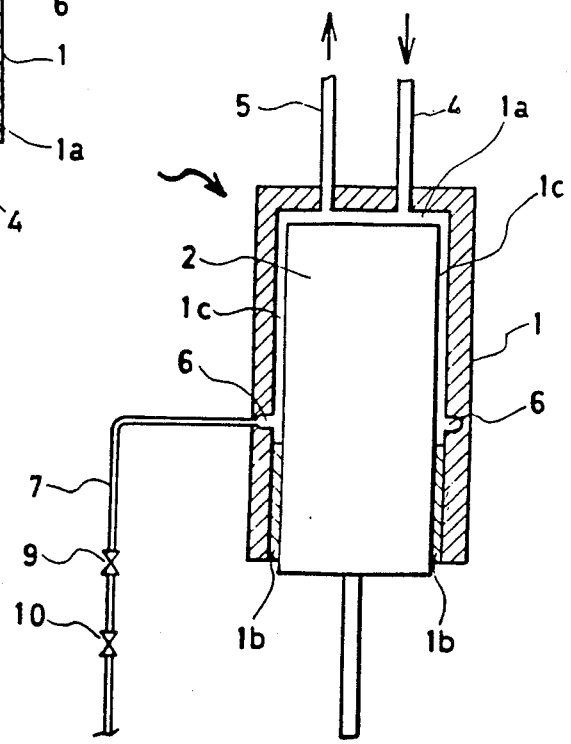
FIG. 4 is a section view of a plunger pump according to a third embodiment of this embodiment.

In FIG. 4, numerals 9 and 10 are a relief valve and a needle valve respectively. The relief valve 9 is actuated in accordance with the internal pressure of the main pump A, whereby the liquid flowing in the manifold groove 6 can be discharged outside the main pump A.

Figure 5:
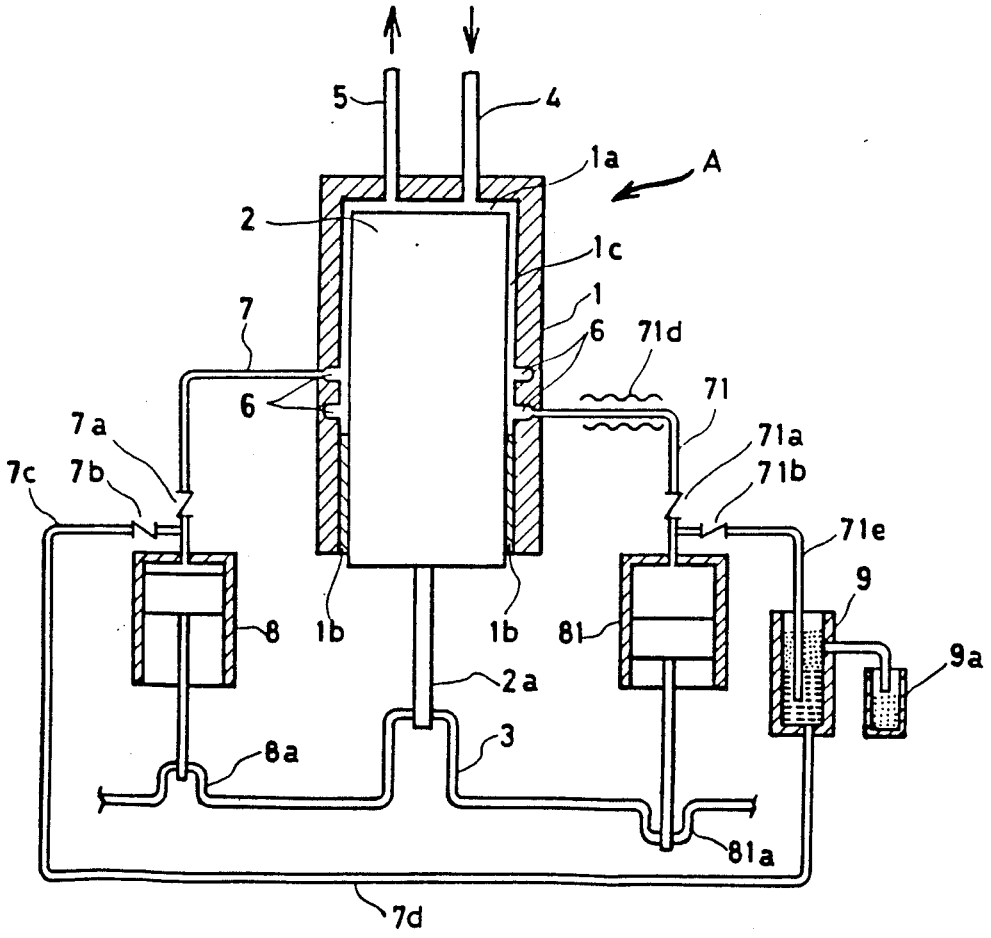
FIG. 5 is a section view of a plunger pump according to a fourth embodiment of this invention.

A fourth embodiment of this invention will now be described with reference to FIG. 5.

Used in the plunger pump according to this embodiment is a concentrated sulfuric acid having a high temperature of 120° C. It is sucked into the sucking chamber 1*a* through the sucking pipe 4 and discharged from the discharge pipe 5.

This embodiment is characterized in that the annular manifold grooves 6 are perforated on the inner surface of the cylinder in a two-stage form and two containers 9 and 9*a* are disposed.

More specifically, the upper manifold groove 6 is communicated with the subpump 8 by way of the subpipe 7, while the lower manifold groove 6 is, by way of the second subpipe 71, communicated with the second subpump 81 carrying out a reciprocating movement contrary to the main pump A.

A first container 9 is communicated with the subpump 81 by way of a diverged discharge pipe 71*e*, while a second container 9*a* is, by way of a pipe, connected to the first container 9 to receive the liquid storing at the upper part thereof. A bottom of the first container 9 is connected to the subpump 8 by way of a pipe 7*d*.

Numeral 71*d* is a cooling means disposed along the discharge pipe 71 to cool a part of the high temperature sulfuric acid discharged from the lower manifold groove 6. Stored in the first container 9 is a cooled inert liquid having a high specific gravity (e.g. "KRYTOX'-'—trade—mark—made by Du Pont Company).

When the high temperature sulfuric acid is sucked into the sucking chamber 1*a* by operation of the main pump A, the cooled inert liquid in the first container 9 is supplied into the upper manifold groove 6 by way of the pipes 7*d*, 7*c*, the non-return valves 7*a*, 7*b* and the subpipe 7. Then, a slight amount of high temperature sulfuric acid coming from the gap 1*c* is mixed with the inert liquid, and supplied into the lower manifold groove 6. Subsequently, by operation of the second subpump 81, the mixture is supplied into the first container 9 through the subpipe 71. Then, it is cooled by the cooling means 71*d*.

The inert liquid having a high specific gravity is sunk at a lower part of the first container 9, while a certain amount of sulfuric acid remains at an upper part thereof. When the latter reaches a certain level, it is supplied to the second container 9*a*.

Accordingly, the slidable means 1*b* is entirely intercepted by an intercepting stream of the inert liquid "KRYTOX", so that it is released from the penetration of the sulfuric acid thereinto. Thus, when the inner wall of the cylinder 1 except for the slidable means 1*b* is coated with a strong acid proof material (e.g. a fluorocarbon resin coating), the cylinder 1 is free from any corrosion by strong acid.

It is not necessary to coat the surface of the slidable means with such a fluorocarbon resin material which has a weak proof, because the intercepting stream prevents the sulfuric acid 1*b* from penetrating into the slidable means 1*b*.

Figure 6:
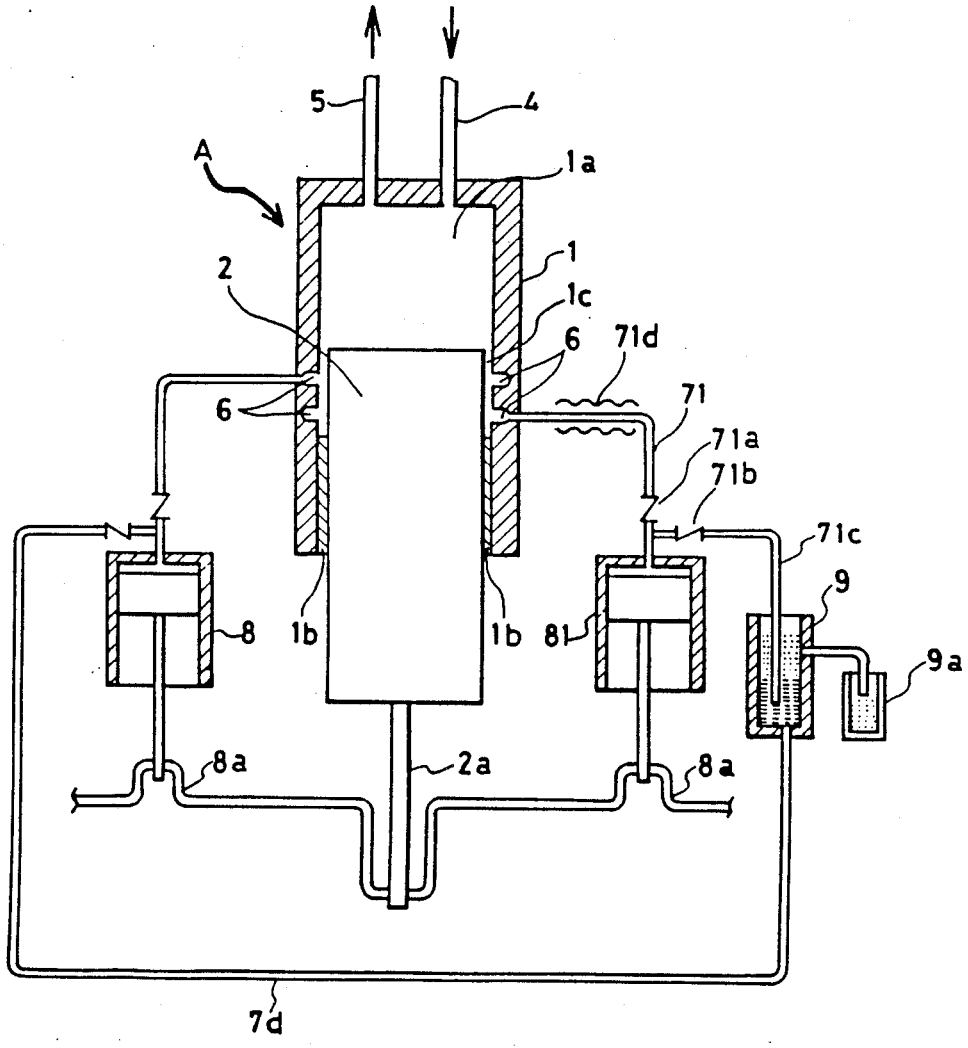
FIG. 6 is a section view of a plunger pump according to a fifth embodiment of this invention.

FIG. 6 shows a fifth embodiment of this invention, in which the two subpumps 8 and 81 carry out a reciprocating movement contrary to that of the main pump A. Namely, the crank shaft 8*a* connected to the main pump and the two subpumps have a symmetrical construction. The other construction is the same as that of the fourth embodiment.

When making use of an active liquid lighter than the liquid which is employed in the aforesaid embodiments, the whole construction in FIG. 6 is preferably inverted up to down.

A sixth embodiment of this invention will now be described with reference to FIG. 7, in which a high pressure plunger pump is employed.

Figure 7:
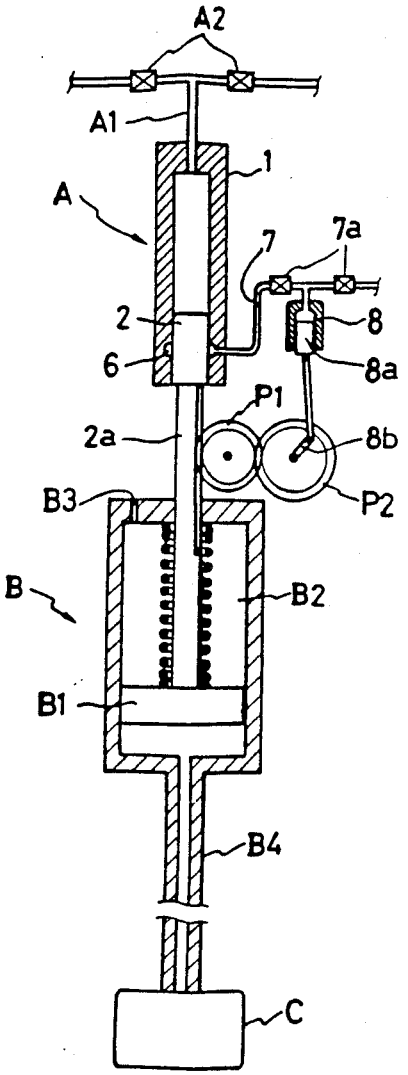
FIG. 7 is a section view of a high pressure plunger pump according to a sixth embodiment of this invention.

In FIG. 7, symbol A denotes a high pressure plunger pump driven by an air cylinder B. The annular manifold groove 6 formed on the inner wall of the cylinder 1, the discharge pipe 7 communicated with the annular manifold groove 6, and other basic components are the same as the previous embodiments.

The air cylinder B is operated by reciprocating a plunger B1 which is driven by a high pressure air that is produced from an air source C by means of a pump B4.

Since the plunger 2 of the high pressure plunger pump A is linked with the plunger B1 of the air cylinder B by the connecting rod 2*a*, the former is reciprocated in synchronization with the reciprocal movement of the latter. The diameter of the plunger B1 is larger than that of the plunger 2, so that a high pressure can be produced in the high pressure pump A.

The connecting rod 2*a* is provided with a rack means which is engaged with a pinion P1. When the connecting rod 2*a* is reciprocated, the pinion P1 and the pinion P2 engaged therewith are rotated. Then, in synchronization with the plunger 2 of the pump A, a plunger 8*a* of the subpump 8 is reciprocated by a reciprocal movement of a crank shaft 8*b* connected with the pinion P2. Under such circumstances, any contaminants within the cylinder can be discharged from the discharge pipe 7.

In FIG. 7, symbol A1 is a sucking/discharge pipe of the liquid and symbol A2 is valve means for sucking and discharge. Symbol B2 is a return spring of the plunger B1, and symbol B3 is a hole for discharging air.

INDUSTRIAL UTILITY

As discussed previously, according to this invention, the sucking chamber and the slidable means are intercepted from each other by the intercepting stream formed therebetween, so that any contaminants i.e. worn matters occurring from said slidable means are prevented from being penetrated into the sucking chamber, and discharged outside the plunger pump together with said intercepting stream.

I claim:

1. A plunger pump comprising:

a cylinder;

a plunger reciprocating within said cylinder;

a chamber formed upon a top of said plunger; means, communicating with the chamber, for providing a first fluid to said chamber for pumping by the plunger;

means, communicating with the chamber, for discharging the first fluid pumped by the plunger;

slidable means, fixed upon an inner wall of said cylinder in the proximity of an open end thereof, for effecting sliding between an outer wall of the plunger and an inner wall of the cylinder;

means for providing an intercepting fluid stream incorporating the first fluid and any contaminants occurring from said slidable means from the cylinder;

manifold means formed about the inner wall of the cylinder above said slidable means for receiving the intercepting fluid stream; and means for discharging said intercepting fluid stream outside said plunger pump whereby any contaminants occurring from said slidable means are prevented from penetrating into said chamber and are discharged outside said plunger pump together with said intercepting fluid stream.

2. A plunger pump as claimed in claim 1, further comprising:

a non-sliding gap disposed between said cylinder and said plunger and extending from said manifold means to said chamber;

a discharge pipe communicated with said manifold means; and a subpump connected to said discharge pipe.

3. A plunger pump as claimed in claim 1;

wherein said manifold means includes at least one annular manifold groove;

at least one subpump communicating via at least one discharge pipe with said at least one manifold groove;

wherein an intercepting fluid, different from said fluid pumped by said plunger, is introduced by said at least one subpump into said at least one manifold groove.

4. A plunger pump as claimed in claim 2, further comprising: filter means, associated with said discharge pipe for intercepting any contaminants in the intercepting fluid stream.

5. A plunger pump as claimed in claim 2, further comprising: a first crank shaft associated with said plunger; and a second crank shaft associated with said subpump and coaxially associated with said first crankshaft.

6. A plunger pump as claimed in claim 3, further comprising: filter means, associated with said at least one discharge pipe for intercepting any contaminants in the intercepting fluid stream.

7. A plunger pump as claimed in claim 3, further comprising: a first crank shaft associated with said plunger; and a second crank shaft associated with said subpump and coaxially associated with said first crankshaft.

8. A plunger pump, comprising:

a cylinder;

a plunger reciprocating within said cylinder;

a sucking chamber formed upon a top of said plunger;

a sucking pipe and a discharge pipe respectively communicated with said sucking chamber; and slidable means formed upon an inner wall of said cylinder in the proximity of an open end thereof, characterized in that:

said sucking chamber and said slidable means are intercepted from each other by an intercepting fluid stream formed therebetween, thereby any contaminants occurring from said slidable means are prevented from being penetrated into said sucking chamber and discharged outside said plunger pump together with said intercepting fluid stream, and further characterized in that:

said intercepting stream passage is composed of at least one annular manifold groove formed in a non-sliding gap formed on an inner wall of said cylinder;

a pair of subpumps;

a discharge pipe disposed between said at least one manifold groove and said one subpump; and a discharge pipe disposed between said pair of subpumps, thereby a fluid different from a fluid to be sucked and discharged by said plunger pump flows into said intercepting stream passage.

9. A plunger pump as claimed in claim 8, in which said intercepting stream passage is provided with a filter means, thereby said intercepting stream containing any contaminants being filtered by said filter means.

10. A plunger pump as claimed in claim 8, in which a crank shaft of said subpump is coaxially associated with a crank shaft of said plunger pump.

11. A plunger pump as claimed in claim 5, wherein: the plunger and the subpump are synchronized in-phase by the first and second crankshafts.

12. A plunger pump as claimed in claim 3, wherein:
the at least one subpump includes a first subpump and a second subpump;
the first subpump and the plunger are synchronized in-phase by a first crankshaft; and
the second subpump and the plunger are synchronized out-of-phase by a second crankshaft.

13. A plunger pump as claimed in claim 2, further comprising:
a first non-return valve interposed in the discharge pipe between the subpump and the manifold means; and
a second non-return valve connecting the subpump to the discharge pipe.

14. A plunger pump as claimed in claim 3, further comprising:
a first subpipe communicated with said manifold means;
a first subpump connected to said first subpipe;
a second subpipe communicated with said manifold means;
a second subpump connected to said second subpipe;
a first non-return valve interposed in the first subpipe between the first subpump and the manifold means;
a second non-return valve interposed in the second subpipe between the second subpump and the manifold means;
a third non-return valve connecting the first subpump to a first discharge pipe; and
a fourth non-return valve connecting the second subpump to a second discharge pipe;
wherein the first subpump and the plunger are synchronized in-phase by a first crankshaft; and
the second subpump and the plunger are synchronized out-of-phase by a second crankshaft.

15. A plunger pump as claimed in claim 2, in which the plunger pump is applied for feeding a slurry and is adapted to operate in an inverted up to down position to prevent particles in the slurry from penetrating the non-sliding gap by their own weight.

16. A plunger pump as claimed in claim 1, further comprising:
a relief valve communicating with the manifold means and actuated in accordance with internal pressure in the plunger pump; and
a needle valve communicating with the relief valve for discharging fluid from the relief valve.

17. A plunger pump comprising:
a cylinder;
a plunger reciprocating within said cylinder;
a chamber formed upon a top of said plunger; means, communicating with the chamber, for providing a first fluid to be pumped by the plunger to said chamber;
means, communicating with the chamber, for discharging the first fluid pumped by the plunger;
slidable means, formed upon an inner wall of said cylinder in the proximity of an open end thereof, for effecting sliding between an outer wall of the plunger and an inner wall of the cylinder;
manifold means formed about the inner wall of the cylinder above said slidable means for receiving an intercepting fluid stream whereby any contaminants occurring from said slidable means are prevented from being penetrated into said chamber and are discharged outside said plunger pump together with said intercepting fluid stream;
a non-sliding gap disposed between said cylinder and said plunger and extending from said manifold means to said chamber;
a discharge pipe communicating with said manifold means;
a subpump connected to said discharge pipe; and
filter means, associated with said discharge pipe, for intercepting any contaminants in the intercepting fluid stream.

18. A plunger pump comprising:
a cylinder;
a plunger reciprocating within said cylinder;
a chamber formed upon a top of said plunger means, communicating with the chamber, for providing a first fluid to be pumped by the plunger to said chamber;
means, communicating with the chamber, for discharging the first fluid pumped by the plunger;
slidable means, formed upon an inner wall of said cylinder in the proximity of an open end thereof, for effecting sliding between an outer wall of the plunger and an inner wall of the cylinder;
manifold means formed about the inner wall of the cylinder above said slidable means for receiving an intercepting fluid stream whereby any contaminants occurring from said slidable means are prevented from being penetrated into said chamber and are discharged outside said plunger pump together with said intercepting fluid stream;
said manifold means further including at least one annular manifold groove;
at least one subpump communicating via at least one discharge pipe with said at least one manifold groove wherein an intercepting fluid, different from said fluid pumped by said plunger, is introduced by said at least one subpump into said at least one manifold groove;
a first crank shaft associated with said plunger; and
a second crank shaft associated with said subpump and coaxially associated with said first crankshaft.

19. A plunger pump comprising:
a cylinder;
a plunger reciprocating within said cylinder;
a chamber formed upon a top of said plunger;
means, communicating with the chamber, for providing a first fluid to be pumped by the plunger to said chamber;
means, communicating with the chamber, for discharging the first fluid pumped by the plunger;
slidable means, formed upon an inner wall of said cylinder in the proximity of an open end thereof, for effecting sliding between an outer wall of the plunger and an inner wall of the cylinder;
manifold means formed about the inner wall of the cylinder above said slidable means for receiving an intercepting fluid stream whereby any contaminants occurring from said slidable means are prevented from being penetrated into said chamber and are discharged outside said plunger pump together with said intercepting fluid stream;

said manifold means further including at least one annular manifold groove;

at least one subpump communicating via at least one discharge pipe with said at least one manifold groove wherein an intercepting fluid, different from said fluid pumped by said plunger, is introduced by said at least one subpump into said at least one manifold groove;

the at least one subpump includes a first subpump and a second subpump;

the first subpump and the plunger are synchronized in-phase by a first crankshaft; and the second subpump and the plunger are synchronized out-of-phase by a second crankshaft.

20. A plunger pump comprising:

a cylinder;

a plunger reciprocating within said cylinder;

a chamber formed upon a top of said plunger means, communicating with the chamber, for providing a first fluid to be pumped by the plunger to said chamber;

means, communicating with the chamber, for discharging the first fluid pumped by the plunger;

slidable means, formed upon an inner wall of said cylinder in the proximity of an open end thereof, for effecting sliding between an outer wall of the plunger and an inner wall of the cylinder;

manifold means formed about the inner wall of the cylinder above said slidable means for receiving an intercepting fluid stream whereby any contaminants occurring from said slidable means are prevented from being penetrated into said chamber and are discharged outside said plunger pump together with said intercepting fluid stream;

said manifold means further including at least one annular manifold groove;

at least one subpump communicating via at least one discharge pipe with said at least one manifold groove wherein an intercepting fluid, different from said fluid pumped by said plunger, is introduced by said at least one subpump into said at least one manifold groove;

a first subpipe communicated with said manifold means;

a first subpump connected to said first subpipe;

a second subpipe communicated with said manifold means;

a second subpump connected to said second subpipe;

a first non-return valve interposed in the first subpipe between the first subpump and the manifold means;

a second non-return valve interposed in the second subpipe between the second subpump and the manifold means;

a third non-return valve connecting the first subpump to a first discharge pipe; and a fourth non-return valve connecting the second subpump to a second discharge pipe;

wherein the first subpump and the plunger are synchronized in phase by a first crankshaft; and the second subpump and the plunger are synchronized out-of-phase by a second crankshaft.

* * * * *